US009993131B2

(12) United States Patent
Delgado et al.

(10) Patent No.: US 9,993,131 B2
(45) Date of Patent: Jun. 12, 2018

(54) FILTER ASSEMBLY FOR A DISHWASHER

(71) Applicant: Whirlpool Corporation, Benton Harbor, MI (US)

(72) Inventors: Kristopher L. Delgado, Stevensville, MI (US); Jordan R. Fountain, Millbrae, CA (US); Jacquelyn R. Geda, Saint Joseph, MI (US); Antony M. Rappette, Benton Harbor, MI (US); Rodney M. Welch, Eau Claire, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 586 days.

(21) Appl. No.: 14/657,050

(22) Filed: Mar. 13, 2015

(65) Prior Publication Data

US 2015/0182097 A1 Jul. 2, 2015

Related U.S. Application Data

(62) Division of application No. 13/164,026, filed on Jun. 20, 2011, now Pat. No. 9,005,369.

(51) Int. Cl.
*A47L 15/42* (2006.01)
*A47L 15/00* (2006.01)

(52) U.S. Cl.
CPC ..... *A47L 15/4208* (2013.01); *A47L 15/0039* (2013.01); *A47L 15/4206* (2013.01); *A47L 15/4225* (2013.01); *A47L 2401/08* (2013.01); *A47L 2401/14* (2013.01); *A47L 2501/05* (2013.01); *A47L 2501/36* (2013.01)

(58) Field of Classification Search
None
See application file for complete search history.

(56) References Cited

U.S. PATENT DOCUMENTS

2011/0120508 A1* 5/2011 Yoon ..... A47L 15/4206 134/104.1

* cited by examiner

*Primary Examiner* — Mikhail Kornakov
*Assistant Examiner* — Ryan L. Coleman
(74) *Attorney, Agent, or Firm* — McGarry Bair PC

(57) ABSTRACT

A dishwasher with a tub at least partially defining a treating chamber, a liquid spraying system, a liquid recirculation system defining a recirculation flow path, and a liquid filtering system. The liquid filtering system includes a rotating filter disposed in the recirculation flow path to filter the liquid.

17 Claims, 12 Drawing Sheets

FILTER ASSEMBLY FOR A DISHWASHER

CROSS-REFERENCE TO RELATED APPLICATIONS

The present application represents a divisional application of U.S. patent application Ser. No. 13/164,026 entitled "Filter Assembly for a Dishwasher" filed Jun. 20, 2011, now U.S. Pat. No. 9,005,369, which is expressly incorporated herein by reference.

BACKGROUND OF THE INVENTION

Contemporary dishwashers of the household-appliance type have a wash chamber in which utensils are placed to be washed according to an automatic cycle of operation. Water, alone, or in combination with a treating chemistry, forms a wash liquid that is sprayed onto the utensils during the cycle of operation. The wash liquid may be recirculated onto the utensils during the cycle of operation. A filter may be provided to remove soil particles from the wash liquid.

SUMMARY OF THE INVENTION

According to one aspect of the invention, a dishwasher includes a tub at least partially defining a treating chamber, a liquid spraying system, a liquid recirculation system, and a liquid filtering system. The liquid recirculation system fluidly couples the treating chamber to the liquid spraying system and defines a recirculation flow path. The liquid filtering system includes a rotating filter having an upstream surface and a downstream surface and located within the recirculation flow path such that the sprayed liquid passes through the filter from the upstream surface to the downstream surface to effect a filtering of the sprayed liquid and a diverter overlying and spaced from at least a portion of the upstream surface to form a gap therebetween. The diverter may have a deflectable portion that deflects to permit a passing of objects having a dimension larger than the gap between the diverter and the rotating filter.

According to another aspect of the invention, a dishwasher includes a tub at least partially defining a treating chamber, a liquid spraying system, a liquid recirculation system, and a liquid filtering system. The liquid filtering system includes a rotating filter having an upstream surface and a downstream surface and located within the recirculation flow path such that the sprayed liquid passes through the filter from the upstream surface to the downstream surface to effect a filtering of the sprayed liquid and a diverter overlying and moveable relative to at least a portion of the upstream surface to form a gap between the diverter and the upstream surface, with the size of the gap varying with a position of the diverter relative to the upstream surface. The dishwasher also includes a sensor providing an output indicative of a degree of clogging of the rotating filter and a controller operably coupled to the diverter and the sensor and configured to move the diverter relative to the upstream surface in response to the sensor output to control the size of the gap based on the degree of clogging.

According to yet another aspect of the invention, a dishwasher includes a tub at least partially defining a treating chamber, a liquid spraying system, a liquid recirculation system, and a liquid filtering system. The liquid recirculation system includes a pump having an impeller. The liquid filtering system includes a rotating filter having an upstream surface and a downstream surface. A transmission assembly operably couples the impeller to the rotating filter such that the filter may be selectively rotatably driven at various speeds while the impeller is being driven at a constant speed. The dishwasher also includes a sensor providing an output indicative of a degree of clogging of the rotating filter and a controller operably coupled to the sensor and the transmission assembly and configured to control a speed of rotation of the filter based on the degree of clogging.

DESCRIPTION OF EMBODIMENTS OF THE INVENTION

Figure 1:
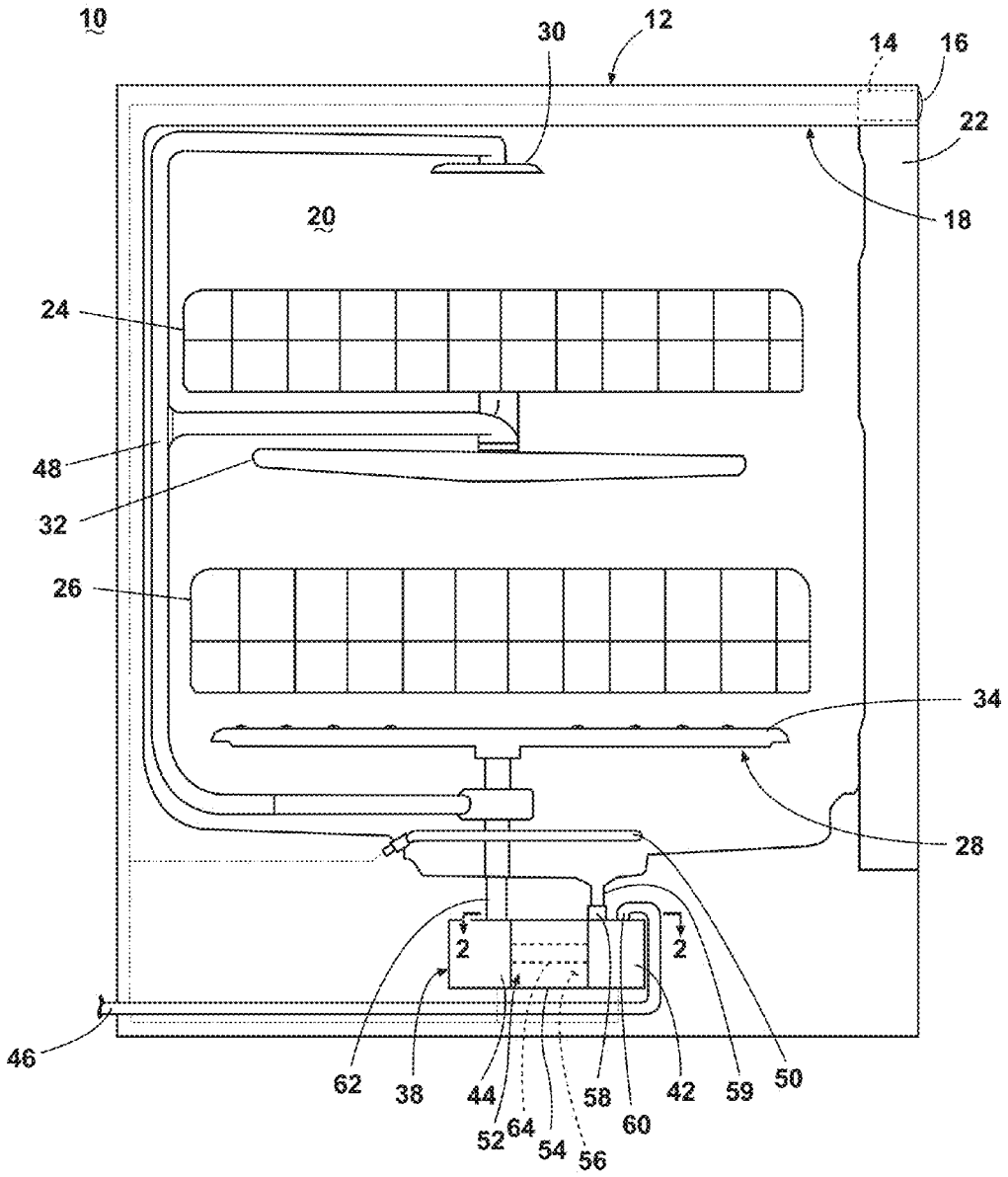
FIG. 1 is a schematic view of a dishwasher according to a first embodiment of the invention.

Referring to FIG. 1, a first embodiment of the invention is illustrated as an automatic dishwasher 10 having a cabinet 12 defining an interior. Depending on whether the dishwasher 10 is a stand-alone or built-in, the cabinet 12 may be a chassis/frame with or without panels attached, respectively. The dishwasher 10 shares many features of a conventional automatic dishwasher, which will not be described in detail herein except as necessary for a complete understanding of the invention. While the present invention is described in terms of a conventional dishwashing unit, it could also be implemented in other types of dishwashing units, such as in-sink dishwashers or drawer-type dishwashers.

A controller 14 may be located within the cabinet 12 and may be operably coupled to various components of the dishwasher 10 to implement one or more cycles of operation. A control panel or user interface 16 may be provided on the dishwasher 10 and coupled to the controller 14. The user interface 16 may include operational controls such as dials, lights, switches, and displays enabling a user to input commands, such as a cycle of operation, to the controller 14 and receive information.

A tub 18 is located within the cabinet 12 and partially defines a treating chamber 20, with an access opening in the form of an open face. A cover, illustrated as a door 22, may be hingedly mounted to the cabinet 12 and may move between an opened position, wherein the user may access the treating chamber 20, and a closed position, as shown in FIG. 1, wherein the door 22 covers or closes the open face of the treating chamber 20.

Utensil holders in the form of upper and lower racks 24, 26 are located within the treating chamber 20 and receive utensils for being treated. The racks 24, 26 are mounted for slidable movement in and out of the treating chamber 20 for ease of loading and unloading. As used in this description, the term "utensil(s)" is intended to be generic to any item, single or plural, that may be treated in the dishwasher 10, including, without limitation: dishes, plates, pots, bowls, pans, glassware, and silverware.

A spraying system 28 is provided for spraying liquid into the treating chamber 20 and is illustrated in the form of an upper sprayer 30, a mid-level sprayer 32, and a lower sprayer 34. The upper sprayer 30 is located above the upper rack 24 and is illustrated as a fixed spray nozzle that sprays liquid downwardly within the treating chamber 20. The mid-level rotatable sprayer 32 and lower rotatable sprayer 34 are located, respectively, beneath upper rack 24 and lower rack 26 and are illustrated as rotating spray arms. The mid-level spray arm 32 may provide a liquid spray upwardly through the bottom of the upper rack 24. The lower rotatable spray arm 34 may provide a liquid spray upwardly through the bottom of the lower rack 26. The mid-level rotatable sprayer 32 may optionally also provide a liquid spray downwardly onto the lower rack 26, but for purposes of simplification, this will not be illustrated herein.

A liquid recirculation system may be provided for recirculating liquid from the treating chamber 20 to the spraying system 28. The recirculation system may include a pump assembly 38. The pump assembly 38 may include both a drain pump 42 and a recirculation pump 44.

The drain pump 42 may draw liquid from a lower portion of the tub 18 and pump the liquid out of the dishwasher 10 to a household drain line 46. The recirculation pump 44 may draw liquid from a lower portion of the tub 18 and pump the liquid to the spraying system 28 to supply liquid into the treating chamber 20.

As illustrated, liquid may be supplied to the mid-level rotatable sprayer 32 and upper sprayer 30 through a supply tube 48 that extends generally rearward from the recirculation pump 44 and upwardly along a rear wall of the tub 18. While the supply tube 48 ultimately supplies liquid to the mid-level rotatable sprayer 32 and upper sprayer 30, it may fluidly communicate with one or more manifold tubes that directly transport liquid to the mid-level rotatable sprayer 32 and upper sprayer 30. The sprayers 30, 32, 34 spray treating chemistry, including only water, onto the dish racks 24, 26 (and hence any utensils positioned thereon) to effect a recirculation of the liquid from the treating chamber 20 to the liquid spraying system 28 to define a recirculation flow path.

A heating system having a heater 50 may be located within or near a lower portion of the tub 18 for heating liquid contained therein.

A liquid filtering system 52 may be fluidly coupled to the recirculation flow path for filtering the recirculated liquid and may include a housing 54 defining a sump or filter chamber 56. As illustrated, the housing 54 is physically separate from the tub 18 and provides a mounting structure for the recirculation pump 44 and drain pump 42. The housing 54 has an inlet port 58, which is fluidly coupled to the treating chamber 20 through a conduit 59 and an outlet port 60, which is fluidly coupled to the drain pump 42 such that the drain pump 42 may effect a supplying of liquid from the sump to the household drain 46. Another outlet port 62 extends upwardly from the recirculation pump 44 and is fluidly coupled to the liquid spraying system 28 such that the recirculation pump 44 may effect a supplying of the liquid to the sprayers 30, 32, 34. A filter element 64, shown in phantom, has been illustrated as being located within the housing 54 between the inlet port 58 and the recirculation pump 44.

Figure 2:
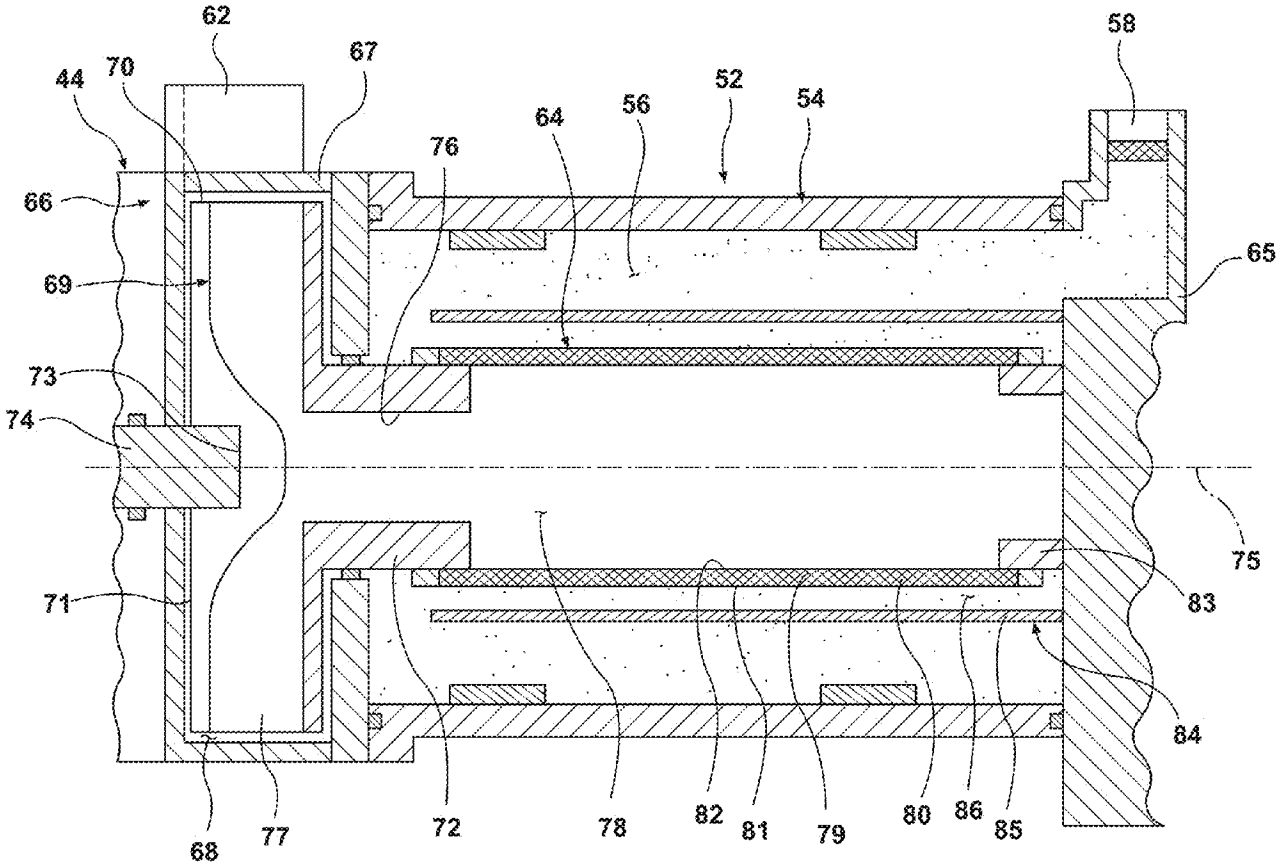
FIG. 2 is a cross-sectional view of a filter assembly and a portion of a recirculation pump of FIG. 1 taken along the line 2-2 shown in FIG. 1.

Referring now to FIG. 2, a cross-sectional view of the liquid filtering system 52 and a portion of the recirculation pump 44 is shown. The housing 54 has been illustrated as a hollow cylinder, which extends from an end secured to a manifold 65 to an opposite end secured to the recirculation pump 44. The inlet port 58 is illustrated as extending upwardly from the manifold 65 and is configured to direct liquid from a lower portion of the tub 18 into the filter chamber 56. The recirculation pump 44 is secured at the opposite end of the housing 54 from the inlet port 58.

The recirculation pump 44 includes a motor 66 (only partially illustrated in FIG. 2) secured to a cylindrical pump housing 67. One end of the pump housing 67 is secured to the motor 66 while the other end is secured to the housing 54. The pump housing 67 defines an impeller chamber 68 that fills with fluid from the filter chamber 56. The outlet port 62 is coupled to the pump housing 67 and opens into the impeller chamber 68.

The recirculation pump 44 also includes an impeller 69. The impeller 69 has a shell 70 that extends from a back end 71 to a front end 72. The back end 71 of the shell 70 is positioned in the chamber 68 and has a bore 73 formed therein. A drive shaft 74, which is rotatably coupled to the motor 66, is received in the bore 73. The motor 66 acts on the drive shaft 74 to rotate the impeller 69 about an axis 75. The motor 66 is connected to a power supply (not shown), which provides the electric current necessary for the motor 66 to spin the drive shaft 74 and rotate the impeller 69. The front end 72 of the impeller shell 70 is positioned in the filter chamber 56 of the housing 54 and has an inlet opening 76 formed in the center thereof. The shell 70 has a number of vanes 77 that extend away from the inlet opening 76 to an outer edge of the shell 70. The front end 72 of the impeller shell 70 is coupled to the filter element 64 positioned in the filter chamber 56 of the housing 54.

The filter element 64 may be a cylindrical filter and is illustrated as extending from an end secured to the impeller shell 70 to an end rotatably coupled to a bearing 83, which is secured to the manifold 65. As such, the filter 64 is operable to rotate about the axis 75 with the impeller 69. The filter element 64 encloses a hollow interior 78 and may be formed by a sheet 79 having a number of passages 80. Each passage 80 extends from an upstream surface 81 of the sheet 79 to a downstream surface 82. In the illustrative embodiment, the sheet 79 is a sheet of chemically etched metal. Each passage 80 is sized to allow for the passage of wash fluid into the hollow interior 78 and prevent the passage of soil particles.

As such, the filter 64 divides the filter chamber 56 into two parts. As wash fluid and removed soil particles enter the filter chamber 56 through the inlet port 58, a mixture of fluid and soil particles is collected in the filter chamber 56 in a region external to the filter 64. Because the passages 80 permit fluid to pass into the hollow interior 78, a volume of filtered fluid is formed in the hollow interior 78. In this manner, the filter 64 has an upstream surface and a downstream surface such that the recirculating liquid passes through the filter 64 from the upstream surface to the downstream surface to effect a filtering of the liquid. In the described flow direction, the upstream surface 81 correlates to an outer surface of the filter 64 and the downstream surface 82 correlates to an inner surface of the filter 64. If the flow direction is reversed, the downstream surface may correlate with the outer surface and the upstream surface may correlate with the inner surface.

A passageway (not shown) places the outlet port 60 of the manifold 65 in fluid communication with the filter chamber 56. When the drain pump 42 is energized, fluid and soil particles from a lower portion of the tub 18 pass downwardly through the inlet port 58 into the filter chamber 56. Fluid then advances from the filter chamber 56 through the passageway without going through the filter element 64 and advances out the outlet port 60.

Two artificial boundaries or flow diverters 84 are illustrated as being positioned in the filter chamber 56 externally of the filter 64. Each flow diverter 84 has a body 85 that is spaced from and overlies at least a portion of the upstream surface 81 of the sheet 79 to form a gap 86 therebetween. The body 85 may be operably coupled with the manifold 65 to secure the body 85 to the housing 54.

Figure 3:
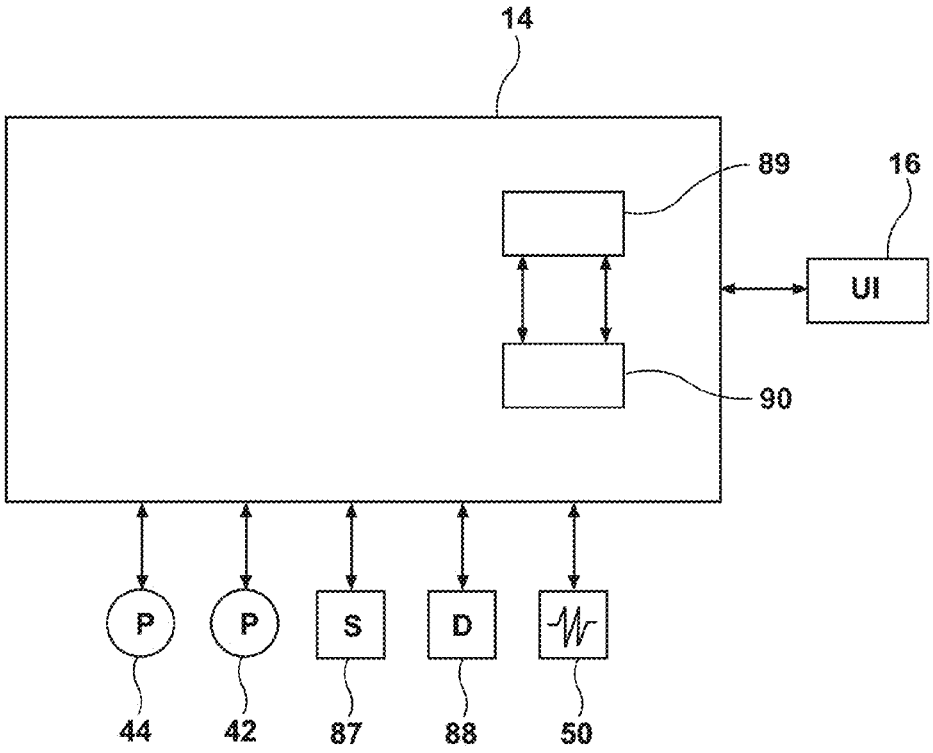
FIG. 3 is a schematic view of a controller of the dishwasher of FIG. 1.

FIG. 3 is a schematic view of the controller 14 of the dishwasher 10 of FIG. 1. As illustrated, the controller 14 may be operably coupled to various components of the dishwasher 10 to implement a cleaning cycle in the treating chamber 20. For example, the controller 14 may be coupled with the recirculation pump 44 for circulation of liquid in the tub 18 and the drain pump 42 for drainage of liquid from the tub 18. The controller may also be coupled with the heater 50 for heating the liquid within the recirculation path. The controller 14 may also receive inputs from one or more other sensors 87, examples of which are known in the art. Non-limiting examples of sensors 87 that may be communicably coupled with the controller include a temperature sensor, a moisture sensor, a door sensor, a detergent and rinse aid presence/type sensor(s). The controller 14 may also be coupled to one or more dispenser(s) 88, which may dispense a detergent into the treating chamber 20 during the wash step of the cycle of operation or a rinse aid during the rinse step of the cycle of operation.

The dishwasher 10 may be preprogrammed with a number of different cleaning cycles from which a user may select one cleaning cycle to clean a load of utensils. Examples of cleaning cycles include normal, light/china, heavy/pots and pans, and rinse only. The user interface 16 may be used for selecting a cleaning cycle or the cleaning cycle may alternatively be automatically selected by the controller 14 based on soil levels sensed by the dishwasher 10 to optimize the cleaning performance of the dishwasher 10 for a particular load of utensils.

The controller 14 may be a microprocessor and may be provided with memory 89 and a central processing unit (CPU) 90. The memory 89 may be used for storing control software that may be executed by the CPU 90 in completing a cycle of operation and any additional software. For example, the memory 89 may store one or more preprogrammed cycles of operation. A cycle of operation may include one or more of the following steps: a wash step, a rinse step, and a drying step. The wash step may further include a pre-wash step and a main wash step. The rinse step may also include multiple steps such as one or more additional rinsing steps performed in addition to a first rinsing.

During operation, wash fluid, such as water and/or treating chemistry (i.e., water and/or detergents, enzymes, surfactants, and other cleaning or conditioning chemistry) passes from the recirculation pump 44 into the spraying system 28 and then exits the spraying system through the sprayers 30-34. After wash fluid contacts the dish racks 24, 26 and any utensils positioned in the treating chamber 20, a mixture of fluid and soil falls onto the bottom wall of the tub 18 and collects in a lower portion of the tub 18 and the filter chamber 56.

As the filter chamber 56 fills, wash fluid passes through the passages 80, extending through the filter sheet 79, into the hollow interior 78. The activation of the motor 66 causes the impeller 69 and the filter 64 to rotate. The rotational speed of the impeller 69 may be controlled by the controller 14 to control a rotational speed of the filter 64. The rotation of the impeller 69 draws wash fluid from the filter chamber 56 through the filter sheet 79 and into the inlet opening 76. Fluid then advances outward along the vanes 77 of the impeller shell 70 and out of the chamber 68 through the outlet port 62 to the spraying system 28. When wash fluid is delivered to the spraying system 28, it is expelled from the spraying system 28 onto any utensils positioned in the treating chamber 20.

While fluid is permitted to pass through the sheet 79, the size of the passages 80 prevents the soil particles of the unfiltered liquid from moving into the hollow interior 78. As a result, those soil particles may accumulate on the upstream surface 81 of the sheet 79 and cover the passages 80 clogging portions of the filter 64 and preventing fluid from passing into the hollow interior 78.

The rotation of the filter 64 about the axis 75 causes the unfiltered liquid of fluid and soil particles within the filter chamber 56 to rotate about the axis 75 with the filter 64. The flow diverters 84 divide the unfiltered liquid into a first portion which advances through the gap 86, and a second portion, which bypasses the gap 86. As the unfiltered liquid advances through the gap 86, the angular velocity of the fluid increases relative to its previous velocity as well as relative to the remainder of the unfiltered liquid that does not travel through the gap 86.

As the flow diverters 84 are stationary within the filter chamber 56, the liquid in contact with each flow diverter 84 is also stationary or has no rotational speed. The liquid in contact with the upstream surface 81 has the same angular speed as the rotating filter 64, which is generally in the range of 3000 rpm and may vary between 1000 to 5000 rpm. The speed of rotation is not limiting to the invention. Thus, the liquid in the gap 86 has an angular speed profile of zero where it is constrained at the flow diverter 84 to approximately 3000 rpm at the upstream surface 81. This requires substantial angular acceleration, which locally generates increased shear forces on the upstream surface 81. Thus, the proximity of the flow diverters 84 to the rotating filter 64 causes an increase in the angular velocity of the liquid within the gap 86 and results in a shear force being applied to the upstream surface 81.

This applied shear force aids in the removal of soils on the upstream surface 81 and is attributable to the interaction of the liquid within the gap 86 and the rotating filter 64. The increased shear force functions to remove soils which may be clogging the filter 64 and/or prevent soils from being trapped on the upstream surface 81. The shear force acts to "scrape" soil particles from the sheet 79 and aids in cleaning the sheet 79 and permitting the passage of fluid through the passages 80 into the hollow interior 78 to create a filtered liquid. The "scraping" in this context is caused by the shear forces generated by the fluid movement and can be characterized as fluidic scraping in contrast with mechanical scraping that may occur when an object physically contacts the filter.

While the flow diverters are illustrated on the exterior of the filter, it is contemplated that they could be located internally of the diverter, such as when the flow is reversed and the interior surface is the upstream side. Additionally, both internal and external flow diverters could be used in combination. The internal flow diverter could be overlying and spaced from the downstream surface 82 and may extend axially within the rotating filter 64 to form a flow straightener. A similar increase in shear force may occur on the downstream surface 82 where the second flow diverter overlies the downstream surface 82. The liquid would have an angular speed profile of zero at the second flow diverter and would increase to approximately 3000 rpm at the downstream surface 82, which generates the increased shear forces.

Figure 4:
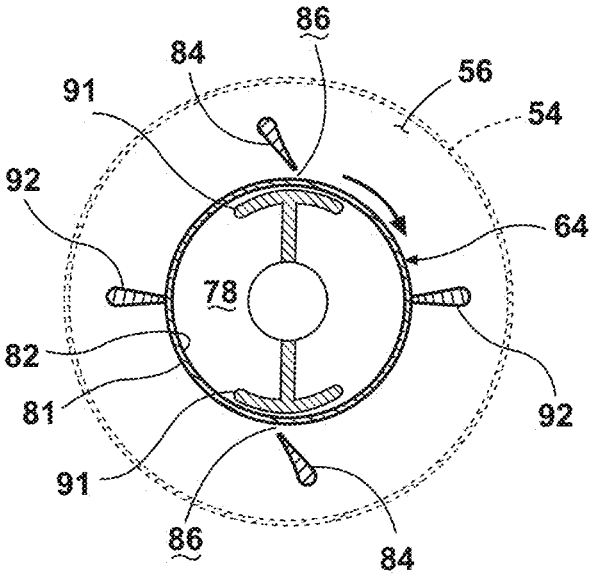
FIG. 4 is a cross-sectional view of a second embodiment of a filter assembly, which may be used in the dishwasher of FIG. 1.

For example, as illustrated in a second embodiment in FIG. 4, internal diverters 91 may be located adjacent the downstream surface 82. The flow diverters 84, 91 may be arranged relative to each other such that they are diametrically opposite each other relative to the filter 64. In this manner each of the flow diverters 84, 91 are arranged to create a pair with the first flow diverter 84 of the pair adjacent the upstream surface 81 and the second flow diverter 91 of the pair adjacent the downstream surface 82. Further, it may be seen that each of the first flow diverters 84 are diametrically opposite each other and that each of the second flow diverters 91 are diametrically opposite each other. It has been contemplated that the first and second flow diverters 84, 91 may have alternative arrangements and spacing. Suitable shapes for the internal flow diverters are set forth in detail in U.S. patent application Ser. No. 12/966,420, filed Dec. 13, 2010, now U.S. Pat. No. 8,667,974, and titled "Rotating Filter for a Dishwashing Machine," which is incorporated herein by reference in its entirety.

Further, in addition to the flow diverters 84, 91, which provide for a fluidic scraping of soils through shear forces as described above, mechanical scrapers 92, which provide mechanical scraping through direct contact with the filter 64, may also be included in the filter chamber 56 externally of the filter 64. As with the flow diverters 84, each mechanical scraper 92 may be operably coupled with the manifold 65 to secure it to the housing 54. Unlike the flow diverters 84, each mechanical scraper 92 is in contact with at least a portion of the filter 64 so that it mechanically removes soil that has accumulated on the surface of the filter 64. It is contemplated that the mechanical scraper 92 may include a single blade or multiple blades or brushes that engage the surface of the filter 64. When the filter 64 is caused to rotate (as indicated by the directional arrow) the mechanical scrapers 92 may engage the moving filter 64 and soils may be scraped away by the mechanical action thereof.

Figure 5:
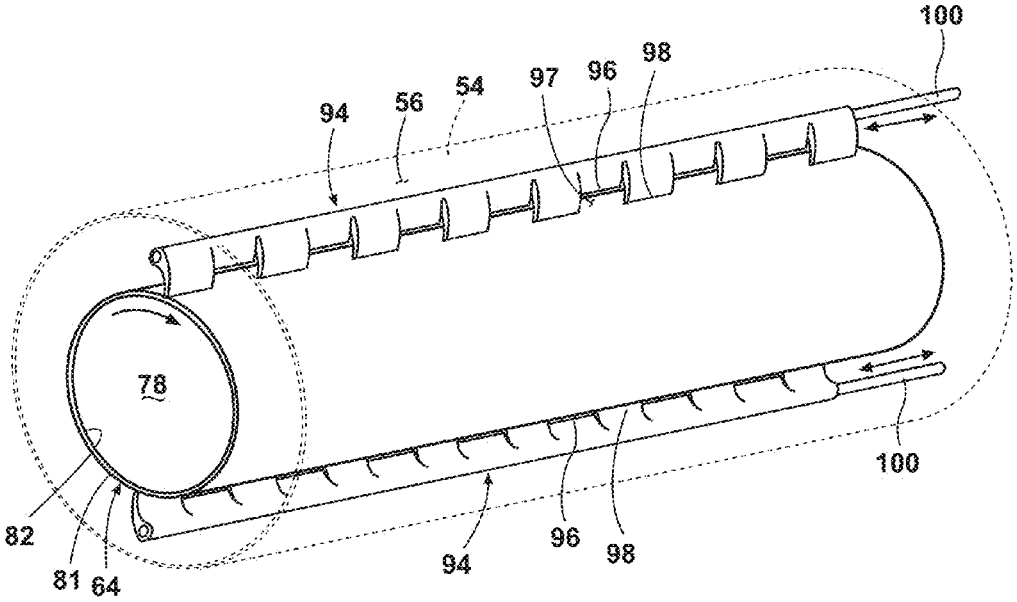
FIG. 5 is a schematic view of a third embodiment of a filter assembly, which may be used in the dishwasher of FIG. 1.

FIG. 5 illustrates a third embodiment wherein a singular body 94 located within the filter chamber 56 may include both a flow diverter 96 and a mechanical scraper 98. The body 94 is illustrated as having multiple flow diverters 96 and multiple mechanical scrapers 98. The flow diverts 96 are spaced from the filter 64 forming gaps 97 between the diverters 96 and the filter 64 and the mechanical scrapers 98 engage the filter 64 as described above. It is contemplated that the mechanical scraper 98 may include a single blade or multiple blades or brushes that engage the surface of the filter 64. The body 94 may be mounted on a pin 100, which may be moveably mounted within the housing 54. The pin 100 may be operably coupled to an axial mover (not shown), which may affect axial movement of the pin 100 and body 94 along the filter 64. It is contemplated that the axial mover may be any suitable mechanism capable of causing the body 94 to move axially along at least a portion of the filter 64 including by way of a non-limiting example, a servo-motor capable of moving the body 94 axially. Alternatively, it is contemplated that the body 94 may be moveably mounted to the pin 100 such that it is capable of axial movement along the pin 100 and the filter 64. Any appropriate type of axial mover may be included to move the body 94 axially along at least a portion of the pin 100. Regardless of the way in which the body 94 may be axially moved along the filter 64, the body 94 and its axial movement along the filter 64 while the filter 64 rotates provides both mechanical and fluidic scraping along the entire outer surface of the of the filter 64.

Figure 6:
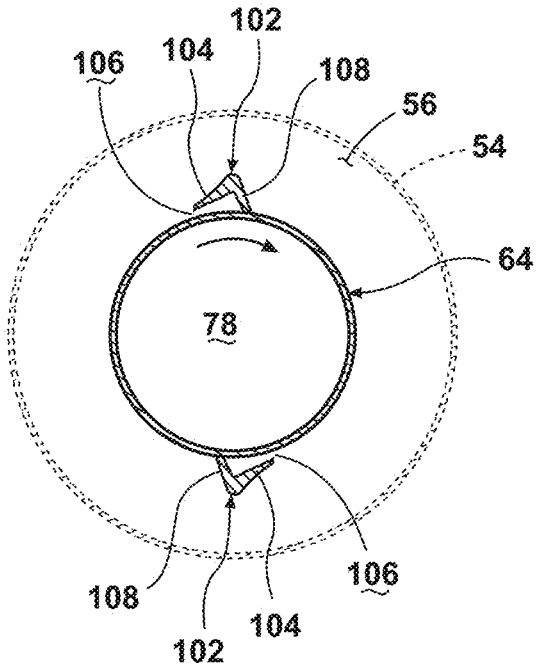
FIG. 6 is a cross-sectional view of a fourth embodiment of a filter assembly, which may be used in the dishwasher of FIG. 1.

FIG. 6 illustrates a fourth embodiment having an alternative singular body 102 having both a flow diverter 104 and a mechanical scraper 108. The body 102 may be operably coupled with the manifold 65 to secure the body 102 to the housing 54 and may run at least a portion of the length of the filter 64. The flow diverter 104 forms a portion of the body 102, which is spaced from and overlies at least a portion of the filter 64 to form a gap 106 therebetween. The mechanical scraper 108 forms a portion of the body 102, which is in contact with a portion of the filter 64 so that it may remove soil that may accumulate on the surface of the filter 64. It is contemplated that the mechanical scraper 108 may include a single blade or multiple blades or brushes that engage the surface of the filter 64. Although the flow diverter 104 and mechanical scraper 108 have been illustrated as being at certain angles with respect to each other and with respect to the filter 64, it is contemplated that the illustrated embodiment is merely by way of non-limiting example and that the body 102 having a diverter 104 and mechanical scraper 108 may be formed in any suitable manner to provide both shear force and mechanical action scraping along the filter 64.

Figure 7A:
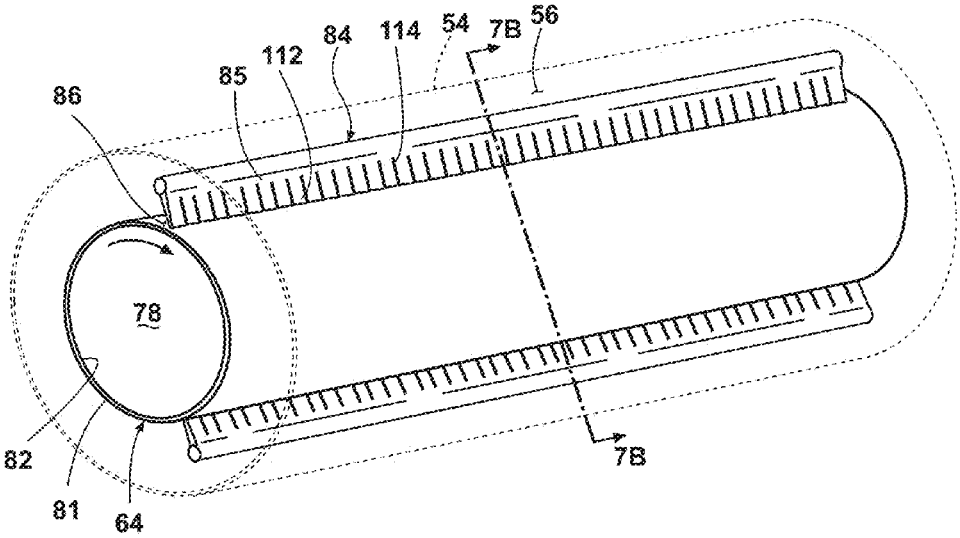
FIG. 7A is a schematic view of a fifth embodiment of a filter assembly, which may be used in the dishwasher of FIG. 1.

FIG. 7A illustrates a fifth embodiment wherein the flow diverter 84 includes a deflectable portion 112, which may deflect to permit a passing of objects having a dimension larger than the gap 86 through the gap 86. Multiple deflectable portions 112 have been illustrated and it has been contemplated that the flow diverter 84 may have any number of deflectable portions 112. The deflectable portions 112 may be formed from an elastomeric portion which may bend and deflect to allow an object to pass between the flow diverter 84 and the upstream surface 81 of the filter 64 without damaging the filter 64. Slits 114 may separate the multiple deflectable portions 112 to aid in allowing the deflectable portions 112 to move with respect to each other. Alternatively, it has also been contemplated that the multiple deflectable portions 112 may not have slits separating them.

Figure 7B:
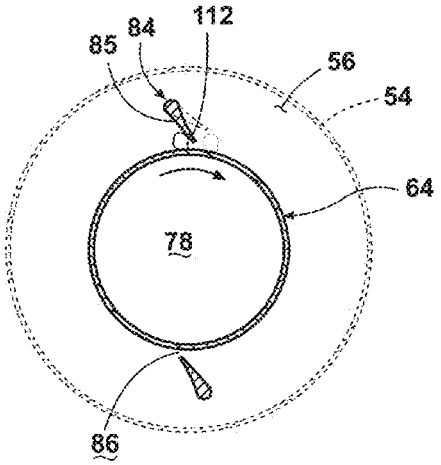
FIG. 7B is a cross-sectional view of the filter assembly of FIG. 7A.

The flow diverter 84 having the deflectable portions 112 operates in much the same way as described above. The rotation of the filter 64 about the axis 75 causes the unfiltered liquid of fluid and soil particles within the filter chamber 56 to rotate about the axis 75 with the filter 64. Some soils within the mixture of fluid and soils may advance through the gap 86. If an object, such as a large piece of soil, having a dimension larger than the gap 86, attempts to advance through the gap 86, one or more deflectable portions 112 may deflect away from the filter 64 to allow the passage of the object between the flow diverter 84 and filter 64 as represented in phantom in FIG. 7B. The deflectable portion 112 may deflect away from the upstream surface 81 of the filter 64 to allow the object to pass through the gap 86 and then return to its original position where it will continue to provide a shear force along the upstream surface 81 of the filter 64.

Figure 8A:
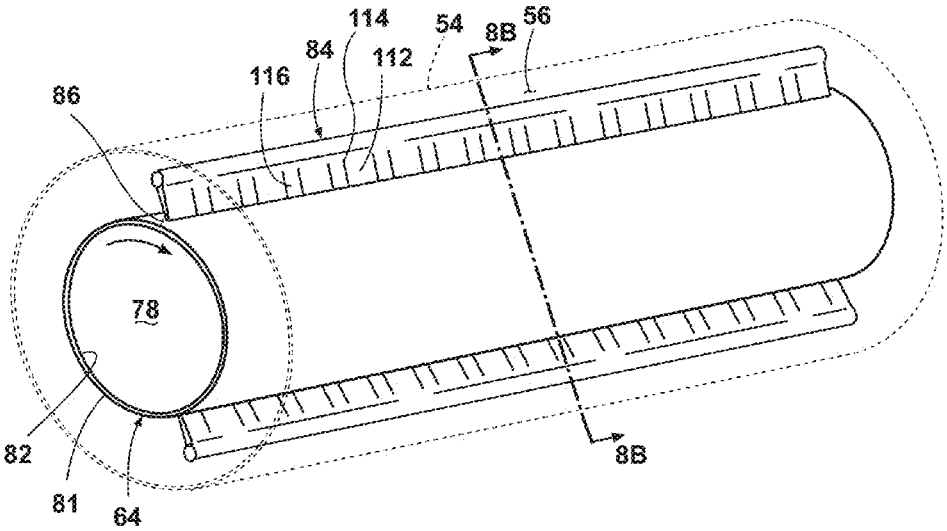
FIG. 8A is a schematic view of a sixth embodiment of a filter assembly, which may be used in the dishwasher of FIG. 1.

FIG. 8A illustrates a sixth embodiment wherein the flow diverter 84 includes a non-deflectable portion 116 in addition to the deflectable portions 112. The flow diverter 84 may have any number of non-deflectable portions 116 in combination with the deflectable portions 112. For illustrative purposes, multiple non-deflectable portions 116 and multiple deflectable portions 112 have been illustrated in alternating sequence. More specifically, the flow diverter 84 has been illustrated as including alternating non-deflectable portions 116 and deflectable portions 112. It has been contemplated that the flow diverter 84 may have any suitable configuration including having any number of non-deflectable portions 116 and deflectable portions 112, and that the non-deflectable portions 116 and deflectable portions 112 may have various shapes and sizes as well as various sequences and arrangements with respect to each other.

Figure 8B:
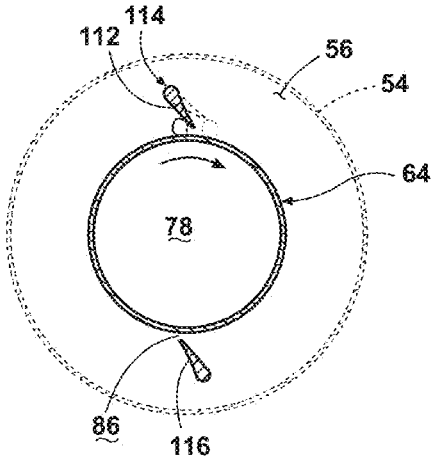
FIG. 8B is a cross-sectional view of the filter assembly of FIG. 8A.

The flow diverter 84 having the deflectable portions 112 and non-deflectable portions 116 operates in much the same way as described above with respect to the sixth embodiment. If an object, which is larger than the gap 86 attempts to advance through the gap 86, the non-deflectable portions 116 will not deflect to allow the object to pass as illustrated in FIG. 8B. The object may be knocked down or outward by the non-deflectable portion 116 to the bottom of the housing 54 or the object may be drawn along until it reaches a deflectable portion 112, which will then deflect away from the filter 64 to allow the passage of the object.

Figure 9A:
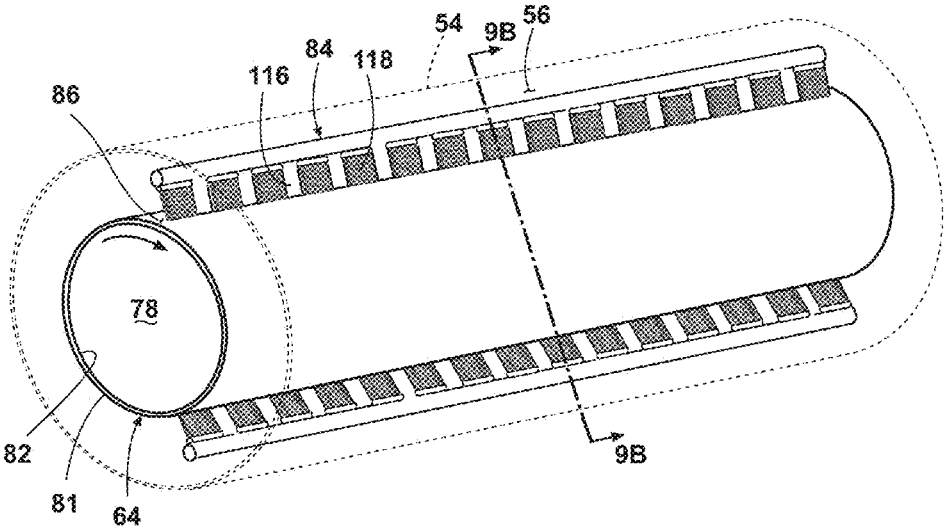
FIG. 9A is a schematic view of a seventh embodiment of a filter assembly, which may be used in the dishwasher of FIG. 1.

FIG. 9A illustrates a seventh embodiment wherein the deflectable portions are illustrated as bristles 118. The bristles 118 may be arranged in several layers along the width of the flow diverter 84 such that the bristles 118 have a thickness. Alternatively, it has been contemplated that a single layer of bristles 118 may be used as the deflectable portion. Further, it has been contemplated that the bristles 118 may be positioned next to each other or may be spaced from each other along the length of the flow diverter 84. The bristles 118 may also have varying lengths or thicknesses. It has also been contemplated that the flow diverter 84 may have any suitable configuration including having any number of bristles 118 and any number of other non-deflectable portions 112 or deflectable portions (not shown) and that the bristles 118, non-deflectable portions 112, and deflectable portions may have various shapes and sizes, and may have various sequences and arrangements with respect to each other.

Figure 9B:
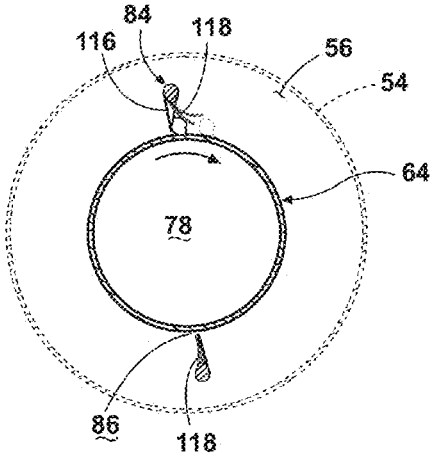
FIG. 9B is a cross-sectional view of the filter assembly of FIG. 9A.

The flow diverter 84 having the deflectable bristles 118 operates in much the same way as the flow diverter 84 described above with respect to the sixth embodiment. If a large piece of soil advances through the gap 86 multiple bristles 118 may deflect away from the filter 64 to allow the passage of the object between the flow diverter 84 and filter 64 as illustrated in FIG. 9B. Once the object passes by each bristle 118, the bristle 118 returns to its original position where it will continue to provide a shear force along the upstream surface 81 of the filter 64.

Figure 10:
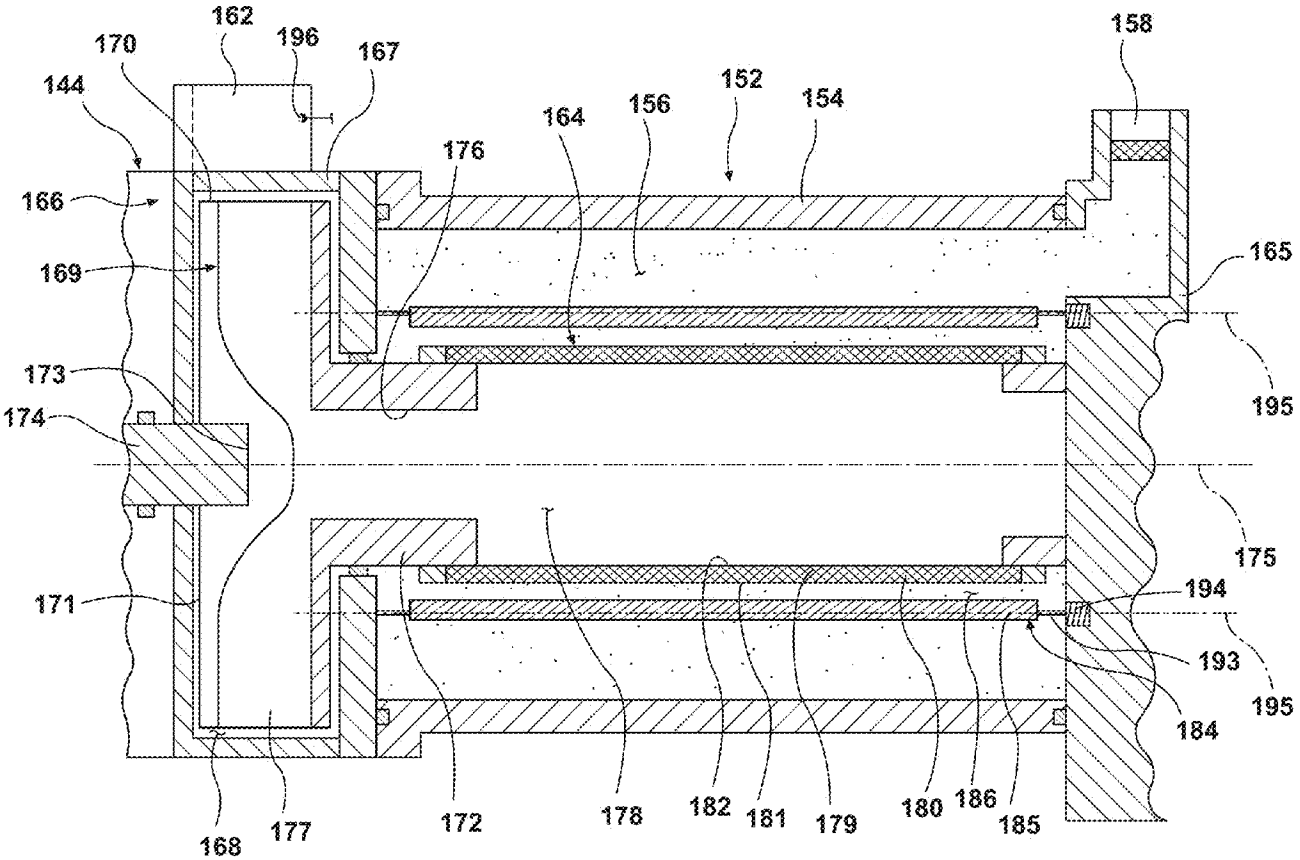
FIG. 10 is a cross-sectional view of an eighth embodiment of a filter assembly and a portion of a recirculation pump, which may be used in the dishwasher of FIG. 1.

FIG. 10 illustrates a recirculation pump 144 and liquid filtering system 152 according to an eight embodiment of the invention. The eighth embodiment is similar to the first embodiment; therefore, like parts will be identified with like numerals increased by 100, with it being understood that the description of the like parts of the first embodiment applies to the eighth embodiment, unless otherwise noted.

The eighth embodiment includes two flow diverters 184. Each flow diverter 184 overlies a portion of the upstream surface 181 and forms a gap 186 between the flow diverter 184 and the upstream surface 181. One difference between the eighth embodiment and the first embodiment is that the entire body 185 of the flow diverter 184 is moveable by the controller 14 relative to the upstream surface 181 such that the size of the gap 186 may be selectively varied by the controller 14.

Movement of the flow diverter 184 may be accomplished by rotating the flow diverter relative to the filter 164. The rotation may be accomplished by providing a pin 193 through the body 185, which may extend beyond the body 185 on either end. The pin 193 may be rotatably mounted at one end to the pump housing 167 and at the other end to the manifold 165, such that the pin 193 defines an axis of rotation for the body 185.

A motor 194 may be operably coupled to the pin 193 to effect a rotation of the pin 193 and thereby rotate the body 185. The motor 194 may act on the pin 193 to rotate the body 185 about an axis 195, which is defined by the pin 193. The pin 193 is illustrated as passing through a nonsymmetrical axis 195 of the body 185 such that the rotation of the body 185 causes a part of the body 185 to be moved towards or away from the filter 164 and increases or decreases the size of the gap 186. The motor 194 may be any appropriate type of motor such as a solenoid motor or a servo motor and may be connected to a power supply (not shown), which provides the energy necessary for the motor 194 to spin the pin 193 and rotate the body 185 about the axis 195.

Another difference between the eighth embodiment and the first embodiment is that the liquid filtering system 152 includes a sensor 196, which may provide an output indicative of the degree of clogging of the rotating filter 164. The sensor 196 may be capable of providing an output indicative of the pressure of the liquid output by the recirculation pump 144 and has been illustrated as being located in the outlet port 162 for exemplary purposes. The sensor 196 may alternatively be a motor torque sensor (not shown) providing output indicative of the torque of the motor 166. The controller 14 may be operably coupled to the flow diverter 184 and the sensor 196 and may be configured to move the flow diverter 184 relative to the upstream surface 181 in response to the sensor output to control the size of the gap 186 based on a determined degree of clogging.

The eighth embodiment operates much the same way as the first embodiment. That is, during operation of the dishwasher 10, liquid is recirculated and sprayed by the spraying system 28 into the treating chamber 20. The liquid then falls onto the bottom wall of the tub 18 and flows to the liquid filtering system 152. Activation of the motor 166 causes the impeller 169 and the filter 164 to rotate. The rotation of the impeller 169 draws wash fluid from an upstream side in the filter chamber 156 through the rotating filter 164 to a downstream side, into the hollow interior 178, and into the inlet opening 176 where it is then advanced through the recirculation pump 144 back to the spraying system 28. During this time the body 185 may be moved away from the filter 164 such that the gap 186 has a larger size.

While the liquid is being recirculated, the filter 164 may begin to clog with soil particles. This clogging causes the outlet pressure from the recirculation pump 144 to decrease as the clogging of the passages 180 hinders the movement of the liquid into the inlet opening 176. The decrease in the liquid movement into the inlet opening 176 causes an increase in the motor torque. The decrease in the liquid movement into the inlet opening 176 may also cause an increase in the speed of the impeller 166 as the recirculation pump 144 attempts to maintain the same liquid output.

The signal from the sensor 196 may be monitored by the controller 14 and the controller 14 may determine that when the magnitude of the signal satisfies a predetermined threshold there is a particular degree of clogging of the filter 164. The predetermined threshold for the signal magnitude may be selected in light of the characteristics of any given machine. For the purposes of this description, satisfying a predetermined threshold value means that the parameter, in this case the magnitude of the signal, is compared with a reference value and the comparison indicates the satisfying of the sought after condition, in this case the clogging of the filter 164. Reference values are easily selected or numerically modified such that any typical comparison can be substituted (greater than, less than, equal to, not equal to, etc.). The form of the reference value and the magnitude signal value may also be similarly selected, such as by using an average, a maximum, etc.

The controller 14 may also compare the magnitude of the sensor signal to multiple references values to determine the degree of clogging. The controller 14 may also determine the degree of clogging by determining a change in the monitored signal over time as such a determined change may also be illustrative of a degree of clogging of the filter 164. For purposes of this description, it is only necessary that some form of the sensor signal be compared to at least one reference value in such a way that a determination can be made about the degree of clogging of the filter 164.

Once the controller 14 has determined that a degree of clogging exists, the controller 14 may automatically move the flow diverter 184 relative to the rotating filter 164 to adjust the size of the gap 186 based on the determined degree of clogging. To do this the controller 14 may operate the motor 194 to move the flow diverter 184 closer to the upstream surface 181 of the filter 164 as the degree of clogging increases. More specifically, the controller 14 may actuate the motor 194 such that the motor 194 turns the body 185 until it is moved towards the filter 164 and the gap 186 is reduced.

As the size of the gap 186 is decreased the liquid traveling through the gap 186 has an increased angular acceleration through the gap 186. The increase in the angular acceleration of the liquid creates an increased shear force, which is applied to the upstream surface 181. The increased share force has a magnitude, which is greater than what would be applied if the flow diverter 184 were orientated such that the body 185 was moved away from the filter 164.

This greater magnitude shear force aids in the removal of soils on the upstream surface 181 and is attributable to the interaction of the liquid traveling through the gap 186 and the rotating filter 164. The increased shear force functions to remove soils that are trapped on the upstream surface 181 and decreases the degree of clogging of the filter 164. Once the degree of clogging has been reduced the controller 14 may again actuate the motor 194 such that the motor 194 rotates the flow diverter 184 until the body 185 is moved away from the filter 164 and the size of the gap 186 is increased.

It is contemplated that the body 185 may have various shapes and may be moved by the controller 14 in various manners such that the moving of the flow diverter 184 may be proportional to the degree of clogging. There may be a variety of ways in which the gap 186 may be made smaller as the degree of clogging increases to allow for increased shear force to be applied when the degree of clogging increases. By way of a non-limiting example, the motor 194 may be operably coupled to the flow diverter 184 such that it is capable of moving the flow diverter 184 and pin 193 radially toward/away from the filter 164 instead of merely rotating the flow diverter 184. In such a configuration, additional components may be necessary such as an assembly to translate the output of the motor 194 to radial movement of the flow diverter 184, such reciprocating linear motor moving the pin 193 within slots located in the pump housing 167 and manifold 165. A seal may be necessary to keep liquid from coming into contact with the motor 194.

Other electro-mechanical linkages may be used. For example, the motor 194 itself may form an alternative electro-mechanical linkage, which may couple the rotating filter 164 to the flow diverter 184 such that the size of the gap 186 is controlled based on a rotational speed of the rotating filter 164. As explained above, clogging may result in an increase in the speed of the impeller 169 and this increase in the speed of the impeller 169 causes the speed of the rotating filter 164 to also increase. It has been contemplated that an electro-mechanical linkage may couple the rotating filter 164 to the flow diverter 184 such that the size of the gap 186 is controlled based on a rotational speed of the rotating filter 164. More specifically, as the speed of the rotating filter 164 increases due to clogging, the controller 14 may actuate the motor 194 to move the flow diverter 184 closer to the rotating filter 164. This would increase the shear force being applied to the upstream surface for two reasons. First, the filter 164 would be rotating at increased speeds from its normal operation, which would cause the liquid in contact with the upstream surface 181 to have the same increased angular speed as the rotating filter 164. Second, the size of the gap 186 would be decreased meaning the liquid traveling through the gap 186 would have an even more substantial angular acceleration. The increase in the angular acceleration of the liquid creates an increased shear force that is applied to the upstream surface 181. The increased shear force has a magnitude, which is greater than what would be applied if the flow diverter 184 were further away from the upstream surface 181 of the filter 164 and if the filter 164 were rotating slower.

Alternatively, instead of having a separate motor or component, which is used by the controller 14 to control the movement of the flow diverter 184, the movement of the flow diverter 184 may be controlled by the controller 14 in other manners. For example, it has been contemplated that the controller 14 may be configured to reverse the rotation of the rotating filter 164 to move the flow diverter 184 and control the size of the gap 186. More specifically, the flow diverter 184 may be rotatably mounted on the pin 193 and may be non-aligned with the flow path such that the liquid within the flow path may rotate the flow diverter 184 about the pin 193 and pivot axis 195. In this manner the pin 193 itself may serve as a pivot for the flow diverter 184 such that when the filter 164 is rotating in the normal direction the flow diverter 184 is turned such that the body 185 is moved away from the upstream surface 181 and the gap 186 is larger and when the filter 164 is rotated in the reverse direction the liquid in the filter chamber 156 rotates in the opposite direction and causes the flow diverter 184 to pivot about the pin 193 such that the body 185 is moved towards the upstream surface 181 and the gap 186 is decreased. In this manner, the controller 14 may control the direction of rotation of the rotating filter 164 to reposition the flow diverter 184 and change the size of the gap 186.

Figure 11:
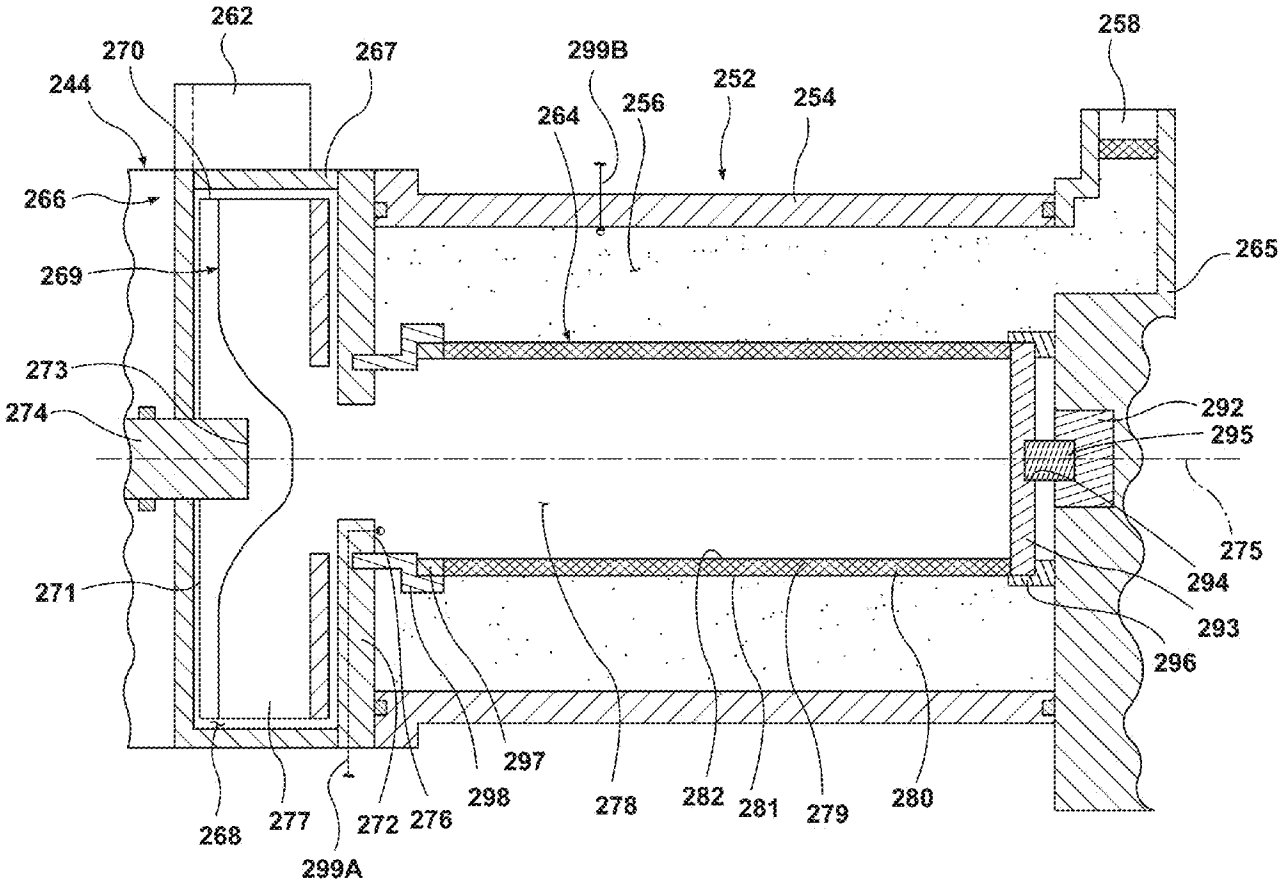
FIG. 11 is a cross-sectional view of a ninth embodiment of a filter assembly and a portion of a recirculation pump, which may be used in the dishwasher of FIG. 1.

FIG. 11 illustrates a recirculation pump 244 and liquid filtering system 252 according to a ninth embodiment of the invention. The ninth embodiment is similar to the first embodiment; therefore, like parts will be identified with like numerals increased by 200, with it being understood that the description of the like parts of the first embodiment applies to the ninth embodiment, unless otherwise noted.

One difference between the ninth embodiment and the first embodiment is that the filter 264 is illustrated as being operably coupled to a motor 292 such that the motor 292 may drive the rotatable filter 264. More specifically, the filter 264 may have an end portion 293 with a bore 294 formed therein. A drive shaft 295, which is rotatably coupled to the motor 292, may be received in the bore 294. The motor 292 acts on the drive shaft 294 to rotate the filter 264 about an imaginary axis 275. The motor 292 is connected to a power supply (not shown), which provides the electric current necessary for the motor 292 to spin the drive shaft 295 and rotate the filter 264. The motor 292 may be a variable speed motor such that the filter 264 may be rotated at various predetermined operating speeds.

The end portion 293 of the filter 264 may be rotatably coupled to a bearing 296, which is secured to the manifold 265. The opposite end 297 of the filter 264 may also be coupled to a bearing 298, which is secured to the front end 272 of the impeller shell 270 such that the filter 264 is operable to rotate about the axis 275.

The liquid filtering system 252 may include a sensor capable of providing an output indicative of a degree of clogging of the rotating filter 264. As described above, such a sensor may include a pressure sensor for sensing the liquid output by the recirculation pump 244 or a motor torque sensor. An alternative sensor capable of providing an output indicative of the pressure across the filter 264 has been illustrated as including sensors 299A and 299B. The first sensor 299A is located within the hollow interior 278 for sensing the pressure on the downstream side of the filter 264. The second sensor 299B is located within the filter chamber 256 for sensing the pressure on the upstream side of the filter 264. In this manner, the controller 14 may determine from the signals output by the sensors 299A, 299B what the pressure across the filter 264 is. Alternatively, a single sensor may be used to sense the pressure across the filter 264. The controller 14 may be operably coupled to the components of the dishwasher 10 including the recirculation pump motor 266, the motor 292, and the pressure sensors 299A, 299B and may be configured to vary a rotational speed of the filter 264 based on the determined degree of clogging. Although flow diverters have not been included in the illustration it has been contemplated that they may be included in the liquid filtering system 252.

The ninth embodiment operates much the same way as the first embodiment; however, activation of the motor 266 only causes the impeller 269 to rotate. The rotation of the impeller 269 draws wash fluid from an upstream side in the filter chamber 256 through the filter 264 to a downstream side, into the hollow interior 278, and into the inlet opening 276 where it is then advanced through the recirculation pump 244 back to the spraying system 28. It is contemplated that during this time the filter 264 may be stationary or that the motor 292 may be rotating the filter 264 at a predetermined operating rate of rotation. For example, the motor 292 may be rotating the filter 264 at a speed which is less than the rotation of the impeller 269. This may result in less power usage for the dishwasher 10 as the motor 266 is not required to output as much power to rotate both the impeller and the filter 264. Further, the filter 264 being rotated by the separate motor 292 may result in a decrease in the sound level created by the dishwasher 10.

While the liquid is being recirculated, the filter 264 may begin to clog with soil particles. The signal from the sensors 299A, 299B may be monitored by the controller 14 and the controller 14 may determine that when the pressure change across the filter 264 satisfies a predetermined threshold there is a particular degree of clogging of the filter 264. Once the controller 14 has determined that a degree of clogging exists it may determine if the degree of clogging satisfies a predetermined threshold and action should be taken.

Upon determining that the degree of clogging satisfies the predetermined threshold the controller 14 may operate the motor 292 to vary the rotational speed of the filter 264. The variation in the rotational speed of the filter 264 may be proportional to the determined degree of clogging. More specifically, the rotational speed of the filter 264 may be increased upon a determined increase in the degree of clogging. If the filter 264 is not moving, this would include beginning to rotate the filter 264 and if the filter 264 is already rotating, this would include rotating the filter 264 at an increased rotational rate.

Starting to rotate the filter 264 or increasing the rotational speed of the filter 264 will aid in unclogging the filter 264 and removing soils from the upstream surface 281. Such cleaning is attributable to the interaction of the liquid and the rotating filter 264. Once the degree of clogging has been reduced the controller 14 may slow the rotation of the filter 264 back to a predetermined operating speed or may stop the rotation of the filter 264.

It has been contemplated that the controller 14 may determine a degree of clogging based on the rotational rate of the filter 264. More specifically, it has been determined that the filter 264 may slow down from its predetermined operating rate of rotation due to clogging of the filter 264 and that the controller 14 may be configured to determine a decrease in the rotational speed of the filter 264 and determine a degree of clogging of the filter 264 based on the determined decrease in the rotational speed of the filter 264. The decrease in the rotational speed of the filter 264 is relative to the predetermined operating speed.

It has also been contemplated that the degree of clogging of the filter 264 may be useful in determining information about the soil load of the utensils located in the treating chamber 20. For example, a larger degree of clogging may correlate to a heavier soil load. It has been determined that such information may be useful in controlling the cycle of operation. That is, the controller 14 may control the execution of the cycle of operation of the dishwasher 10 based on the determined degree of clogging. For example, the controller 14 may control the execution of the cycle by setting a parameter of the cycle of operation, terminating a phase of the cycle of operation, and terminating the cycle of operation. Exemplary parameters which may be set include setting a treating chemistry dosage, setting the number of treating chemistry dosings, setting a phase time, setting a cycle time, setting a liquid temperature, and setting the mix of phases comprising the cycle of operation.

Figure 12:
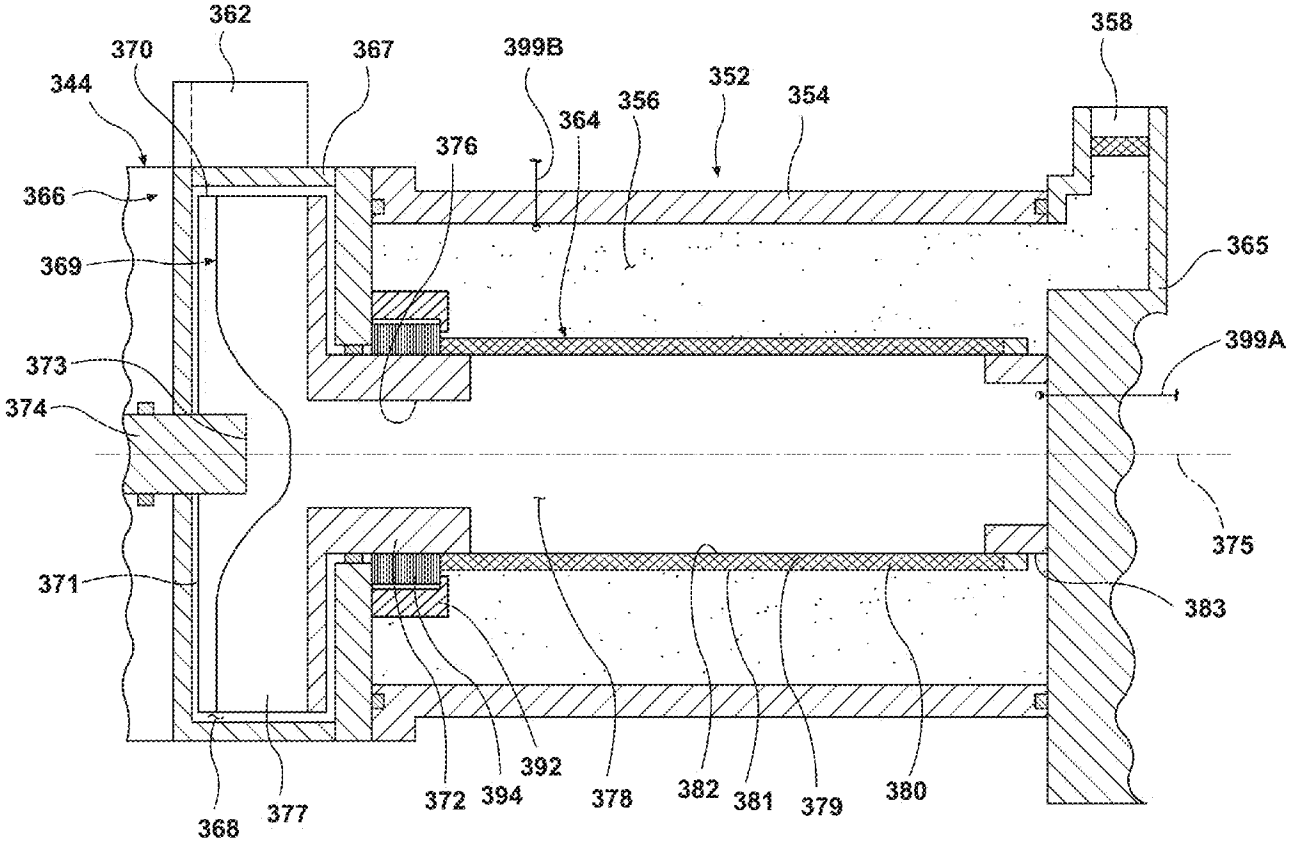
FIG. 12 is a cross-sectional view of a tenth embodiment of a filter assembly and a portion of a recirculation pump, which may be used in the dishwasher of FIG. 1.

FIG. 12 illustrates a recirculation pump 344 and liquid filtering system 352 according to a tenth embodiment of the invention. The tenth embodiment is similar to the first embodiment; therefore, like parts will be identified with like numerals increased by 300, with it being understood that the description of the like parts of the first embodiment applies to the tenth embodiment, unless otherwise noted.

One difference between the tenth embodiment and the first embodiment is that the liquid filtering system 352 is illustrated as including a transmission assembly 392 operably coupling the impeller 369 to the rotating filter 364 such that the filter 364 may be rotatably driven at various speeds while the impeller 369 is being driven at a constant speed and a clutch assembly 394 operably coupling the impeller 369 to the rotating filter 364 such that the filter 364 may be selectively rotatably driven by engagement of the clutch assembly 394. More specifically, when the clutch assembly 394 is engaged by the controller 14 the clutch assembly 394 operably couples the front end 372 of the impeller shell 370 to the filter element 364 such that the filter 364 is operable to rotate about the axis 375 with the impeller 369. When the clutch assembly 394 is disengaged the impeller 369 rotates without co-rotation of the filter 364.

The transmission assembly 392 may be any appropriate transmission assembly. Including, by way of non-limiting example, a transmission assembly having varied gear ratios, which may be engaged to allow the filter 364 to be rotated at varying speeds compared to the rotating impeller 369. For example, the transmission 392 may have gear ratios to increase the rate of rotation of the filter 364 as compared to the impeller 369 and may have other gear ratios to slow the rotation of the filter 364 as compared to the impeller 369. The controller 14 may selectively engage one of the appropriate gear ratios to rotate the filter 364 at a predetermined operating speed. While the clutch assembly and transmission assembly have thus far been described as separate portions in an alternative embodiment, a fluid clutch assembly may be used to operate as both the clutch and transmission, wherein torque may be transmitted through fluid friction between plates.

As with the earlier embodiments the liquid filtering system 352 may include a sensor capable of providing an output indicative of a degree of clogging of the rotating filter 364. The liquid filtering system 352 has been illustrated as including sensors 399A and 399B, which are capable of providing an output indicative of the pressure across the filter 364. The controller 14 may be operably coupled to the components of the dishwasher 10 including the recirculation pump motor 366, the transmission assembly 392, clutch assembly 394, and the pressure sensors 399A, 399B and may be configured to engage and disengage the co-rotation of the filter 364 with the impeller and control a rotational speed of the filter 364 based on the determined degree of clogging. Although flow diverters have not been included in the illustration it has been contemplated that they may be included in the liquid filtering system 352.

The tenth embodiment operates much the same way as the first embodiment. During operation of the dishwasher 10, liquid is recirculated and the filter 364 may begin to clog with soil particles. During the recirculation of the liquid, the filter 364 may be stationary or may be rotated at some predetermined operating speed. The operating speed of the filter 364 may be faster or slower than the rotational speed of the impeller 369 or it may be rotated at the same speed as the impeller 369. The signals from the sensors 399A and 399B may be monitored by the controller 14 and the controller 14 may determine when the pressure drop across the filter 364 indicates that there is a particular degree of clogging of the filter 364.

Once the controller 14 has determined that a degree of clogging exists, the controller 14 may control the speed of rotation of the filter 364 based on the determined degree of clogging. If the filter 364 is not rotating, the controller 14 may engage the clutch assembly 394 such that the filter 364 begins to rotate with the impeller 369. If the filter 364 is already rotating, this may include adjusting the speed at which it is rotating through operation of the transmission assembly 392. In either case the rotational speed of the filter 364 may be increased upon a determined increase in the degree of clogging. Increasing the speed of rotation of the filter 364 will aid in unclogging the filter 364 and removing soils from the upstream surface 381. Once the degree of clogging has been reduced the controller 14 may slow the rotation of the filter 364 back to a predetermined operating speed by adjusting the gear ratio being engaged in the transmission assembly 392 or may stop the rotation of the filter 364 by disengaging the clutch assembly 394. It has also been contemplated that the degree of clogging of the filter 364 as well as the rotational speed of the filter 364 may be useful in determining information about the soil load of the utensils located in the treating chamber 20.

There are a plurality of advantages of the present disclosure arising from the various features of the method, apparatuses, and system described herein. For example, the embodiments of the apparatus described above allow for enhanced filtration such that soil is filtered from the liquid and not re-deposited on utensils. Further, the embodiments of the apparatus described above allow for cleaning of the filter throughout the life of the dishwasher and this maximizes the performance of the dishwasher. Thus, such embodiments require less user maintenance than required by typical dishwashers.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of operating an automatic dishwasher comprising a treating chamber holding utensils, a liquid spraying system including sprayers for spraying liquid on the utensils, and a liquid recirculation system for recirculating spraying liquid back to the sprayers, wherein the recirculation system comprises a rotatable filter for filtering the liquid, the filter having an upstream surface confronting unfiltered liquid, and a downstream surface confronting filter liquid, the method comprising:

spraying liquid within the treating chamber;

recirculating, via a pump having a motor assembly and an impeller, the sprayed liquid from the treating chamber to the sprayers for subsequent spraying to define a recirculation flow path;

receiving, from at least one sensor, an output indicative of a degree of clogging of the rotating filter;

determining, via a controller operably coupled to the at least one sensor, a degree of clogging of the filter based on the output; and varying, via the controller and a transmission assembly, a rotational speed of the filter based on the determined degree of clogging, wherein the transmission assembly couples the impeller to the filter such that rotation of the filter is driven by the impeller.

2. The method of claim 1 wherein determining the degree of clogging comprises determining at least one of a torque of a motor rotating the filter, a pressure output of a pump recirculating the liquid, and a pressure drop across the filter.

3. The method of claim 2 wherein the determining at least one of a torque of a motor rotating the filter, a pressure output of a pump recirculating the liquid, and a pressure drop across the filter comprises determining a change of at least one of a torque of a motor rotating the filter, a pressure output of a pump recirculating the liquid, and a pressure drop across the filter.

4. The method of claim 1 wherein the varying the rotational speed of the filter is proportional to the determined degree of clogging.

5. The method of claim 1 wherein the varying the rotational speed of the filter comprises increasing the rotational speed of the filter upon an increase in the degree of clogging.

6. The method of claim 1 wherein the determining the degree of clogging of the filter comprises determining if the degree of clogging satisfies a predetermined threshold.

7. The method of claim 6 wherein varying the rotational speed of the filter comprises varying the rotational speed of the filter when the degree of clogging satisfies the predetermined threshold.

8. The method of claim 7 wherein varying the rotational speed of the filter comprises rotating the filter from a non-rotating condition.

9. The method of claim 1 wherein varying the rotational speed of the filter comprises rotating the filter from a non-rotating condition.

10. The method of claim 1 wherein varying the rotational speed of the filter comprises reducing the rotational speed of the filter.

11. The method of claim 1 wherein varying the rotational speed of the filter comprises increasing the rotational speed of the filter.

12. An automatic dishwasher for washing utensils according to a cycle of operation, comprising:

a tub at least partially defining a treating chamber;

a liquid spraying system supplying a spray of liquid to the treating chamber;

a liquid recirculation system, including a pump having a motor assembly and an impeller, wherein the liquid recirculation system fluidly couples the treating chamber to the liquid spraying system and defines a recirculation flow path for recirculating the sprayed liquid from the treating chamber to the liquid spraying system; and a liquid filtering system fluidly coupled to the recirculation flow path and comprising a rotating filter having an upstream surface and a downstream surface and located within the recirculation flow path such that the sprayed liquid passes through the filter from the upstream surface to downstream surface to effect a filtering of the sprayed liquid;

a transmission assembly operably coupling the impeller to the rotating filter such that the filter may be selectively rotatably driven at various speeds while the impeller is being driven at a constant speed;

a sensor providing an output indicative of a degree of clogging of the rotating filter; and a controller operably coupled to the sensor and the transmission assembly and configured to control a speed of rotation of the filter based on the degree of clogging.

13. The automatic dishwasher of claim 12 wherein the sensor comprises at least one of a pressure sensor providing output indicative of the pressure of the liquid output by the pump and a pressure sensor providing output indicative of the pressure across the filter.

14. The automatic dishwasher of claim 12 wherein the controller is a microprocessor receiving input from the sensor and controlling movement of the rotating filter.

15. The automatic dishwasher of claim 12 wherein the rotating filter is a cylinder.

16. The automatic dishwasher of claim 12 wherein the controller is configured to rotate the filter faster as the degree of clogging increases.

17. The automatic dishwasher of claim 12 wherein the liquid filtering system further comprises a mechanical scraper that physically contacts at least a portion of the upstream surface to remove soils therefrom.

* * * * *